United States Patent [19]

Durenec et al.

[11] 4,399,661

[45] Aug. 23, 1983

[54] PROLONGED COLD TEMPERATURE CRYOGENIC COOLER

[75] Inventors: Peter Durenec; Steven L. Holt, both of Annandale, Va.

[73] Assignee: The United States of America as represented by the Secretary of the Army, Washington, D.C.

[21] Appl. No.: 404,781

[22] Filed: Aug. 3, 1982

[51] Int. Cl.[3] ..... F25D 13/04

[52] U.S. Cl. ..... 62/65; 62/514 R; 337/307

[58] Field of Search ..... 62/514 R, 65; 337/307

[56] References Cited

U.S. PATENT DOCUMENTS

| | | | |
|---|---|---|---|
| 4,194,119 | 3/1980 | Mackenzie | 62/514 R |
| 4,324,104 | 4/1982 | Horn et al. | 62/514 R |
| 4,366,680 | 1/1983 | Tward | 62/514 R |

*Primary Examiner*—Ronald C. Capossela
*Attorney, Agent, or Firm*—Robert P. Gibson; Milton W. Lee; Max L. Harwell

[57] ABSTRACT

A cold station thermal switch at the end of a cold finger in cooperation with the detector on an inner dewar wherein the thermal switch opens at the cool down cryogenic temperature to prevent vibrations from the cooler system from being transmitted to the detector. The thermal switch has an outer bellows fitted around the end of the last stage of the cooler which extends close to but not in contact with the detector and an inner bellows having a metallic bumper on the end thereof in contact with the detector until cool down to the operating cryogenic temperature at which time contraction of the inner bellows disconnects the metallic bumper from the detector.

12 Claims, 6 Drawing Figures

PROLONGED COLD TEMPERATURE CRYOGENIC COOLER

The invention described herein may be manufactured, used and licensed by the U.S. Government for governmental purposes without the payment of any royalties thereon.

BACKGROUND OF THE INVENTION

1. Field of the Invention

The invention is in the field of cryogenic coolers for cooling thermal viewer detectors which has decreased cool down time and holds at the cold level for a longer period using a cold finger with multiple thermal switches.

2. Description of the Prior Art

In the past problems have existed because the length of the cold finger in cryogenic coolers does not always properly match the length of the dewar well within which the cold finger is mounted. The detectors are mounted on the inner dewar wall facing toward the end of the outer dewar which has a transparent window that passes the radiation frequencies to which the detector is sensitive. Previously, the cold finger extends into the inner dewar until it contacts the end of the dewar, and thus also the detector. This contact of the cold finger with the detector has many disadvantages, such as vibrations from the cooler compressor being transmitted to the detector which adversely effects the image detector and which can easily be detected with sound detection equipment even at large distances. Further disadvantages are that the dewars, which are generally made of polished glass, or the cold finger itself may be damaged during the assembly of the cryogenic cooler and the thermal contact of the end of the cold finger with the detector causes thermal losses after cool down due to heat conduction to the cold station through the cold finger and detector closed thermal circuit.

Efforts have been made to fabricate coolers so that the cold finger is very close to but not touching the detector but it has been extremely difficult to maintain the desired separation.

The present cryogenic cooler alleviates most of these previous problems.

SUMMARY OF THE INVENTION

The present invention is comprised of providing a plurality of cooler stage bellows type thermal switches that are symmetrically positioned around each regenerator-displacer stage of a multistage closed cycle cooler or around each stage of a Joule-Thompson cryostat. A cold station thermal switch is also provided at the end of a cold finger in cooperation with the detector on an inner dewar wherein the cold station thermal switch opens at the cool down cryogenic temperatures to prevent mechanical vibrations from the cooler system being transmitted to the detector. The cold station thermal switch is preferably comprised of an outer serrated cylinder, or outer bellows, that is attached by a fitting means over the end of the last cooling stage of the multistage cooler and an inner bellows having a metallic bumper on the end there of which is in contact with the detector until the cooler reaches the vicinity of the cool down temperature and then separates there from. The outer bellows never touches the end of the inner dewar. The outer bellows is preferably made of stainless steel that is about 0.3 millimeters thick and the inner bellows is preferably made of copper of about 0.3 millimeters thickness and the metallic bumper is made of indium. The inner and outer bellows are maintained separated from each other preferably by at least three evenly spaced annular glass spokes.

The inner dewar is filled with some cooling liquid, such as helium, hydrogen, oxygen, or argon which all have a 1:600 expansion ratio. The cooling liquid will remain trapped between the two bellows at all times and will occupy the small space between the indium bumper and the detector after cool down to help maintain the cold temperature at the detector, yet the detector does not suffer mechanical vibrations by solid contact with the end of the cold finger at the cold temperature. The plurality of cooler stage bellows type thermal switches help maintain the end of the cold finger at the cold temperature since their contacts are closed by contraction during cool down. With the plurality of stages being thermally conductively connected by the cooler stage bellows type switches being closed, the entire length of the cold finger acts as a huge thermal sink, and thus eliminates the need for conductive contact of the end of the cold finger, represented by the indium bumper, with the detector.

One novel means in the assembly process of the present cryogenic cooler is for the cold finger to be first bathed in liquid nitrogen to cause contraction, or as an alternative means of precooling simply turning on the cooler system until the cold finger is at cryogenic and then insert therein. With the cold finger contracted, the cold finger is immediately inserted into the inner dewar. The end of the cold finger, i.e. the indium bumper, is therefore contracted and is not in contact with the end of the inner dewar when the cooler is first assembled. The dewar is generally connected to a cooler system typically by a flange of the cooler system being screw threadably attached to the dewar and cold finger assembly. The cold finger then expands prior to starting of the cooler system but gently makes contact with the detector. The reason for precooling the cold finger is that many coolers are damaged beyond repair during the assembly because the end of the cold finger makes sudden contact with the end of the dewar or the detector.

DETAILED DESCRIPTION OF THE PREFERRED EMBODIMENT

Figure 1:
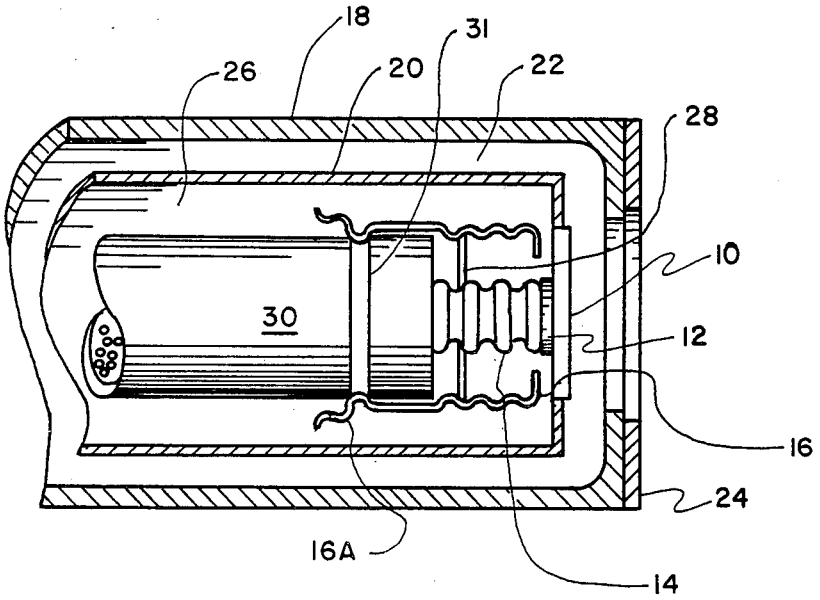
FIG. 1 illustrates a cold station thermal switch used with a closed cycle cooler prior to cool down.
Figure 2:
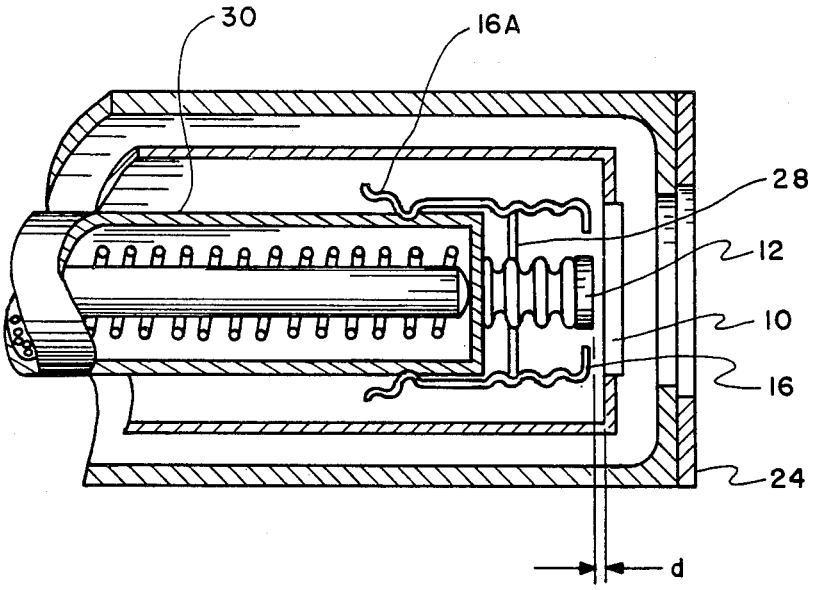
FIG. 2 illustrates the same cold station thermal switch used with a Joule-Thompson cooler after cool down.
Figure 3:
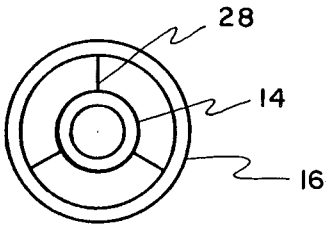
FIG. 3 shows typical positioning of the glass spokes.

Refer first to FIGS. 1, 2, and 3 for an explanation of the cold station thermal switch. It should be noted that numeral 10 will be used in reference to a detector herein but may be other type devices that require cryogenic cooling. Detector 10 is herein shown in direct contact with an indium bumper 12, which is at the end of the inner bellows 14. Detector 10 is secured in the end of an inner dewar wall 20 and faces out the end of an outer dewar wall 18. the end of outer dewar wall 18 is transparent to at least the far infrared or contains a window 24 that will pass radiation frequencies that are sensitive to detector 10. Electrical leads from the detector are not shown since they are not pertinent to the present cooler. During assembly of the cooler an inner volume 26 within the inner dewar wall 20 and which contains the cold finger 30 is filled with the cooling gas in a liquid form. The volume between walls 20 and 18, which contains the detector 10, is evacuated into a vacuum and sealed off in the well known manner. Further, the cooler system itself which is connected by flanges to the dewar and cold finger 30 is not fully shown since the closed cycle cooler as illustrated in FIG. 1 and the Joule-Thompson cooler, i.e. the cryostat, as illustrated in FIG. 2 are well known in the art and are ancillary to present method of prolonging the cold temperature time of a cryogenic cooler.

The cold station thermal switch forms a portion of the end of the cold finger 30 and is comprised of and functions as herein described. First, an inner bellows 14 is attached to the end of cold finger by some attachment means, such as soldering or welding and has an indium bumper 12 on the end thereof. Secondly, an outer bellows 16 is attached over the end of cold finger 30 preferably by a snap attachment means fitting into an annular grove 31 around the end portion of cold finger 30. The outer bellows never touches the end of the inner dewar wall 20, and is preferably made of stainless steel which contracts very little when cooled down. However, the inner bellows 14 is preferably made of copper which has high coefficient of contraction when cooled down. At cool down, as illustrated by FIG. 2 the inner bellows 14 contracts and moves the indium bumper 12 a short distance, represented by d, away from the detector 10. Distance may typically be about 0.0001 inch to 0.002 inch. It should further be noted that outer bellows 16 may have free end dampers 16A which helps to absorb mechanical vibrations of the cooling liquid between the two bellows. The inner and outer bellows are separated by a plurability of evenly spaced glass spokes 28, being at least three as shown in FIG. 3, to maintain a small separation there between of about 0.002 inch to 0.005 inch so that the cooling liquid may freely contact the inner bellows 14 and maintain cooling liquid in the vicinity of detector 10 after cool down and when bumper 12 is not in contact with detector 10. It shoudl be noted that stainless steel is a poor heat conductor at cryogenic temperatures and therefore isolates the cooling liquid about the copper inner bellows 14 and detector 10.

Figure 4:
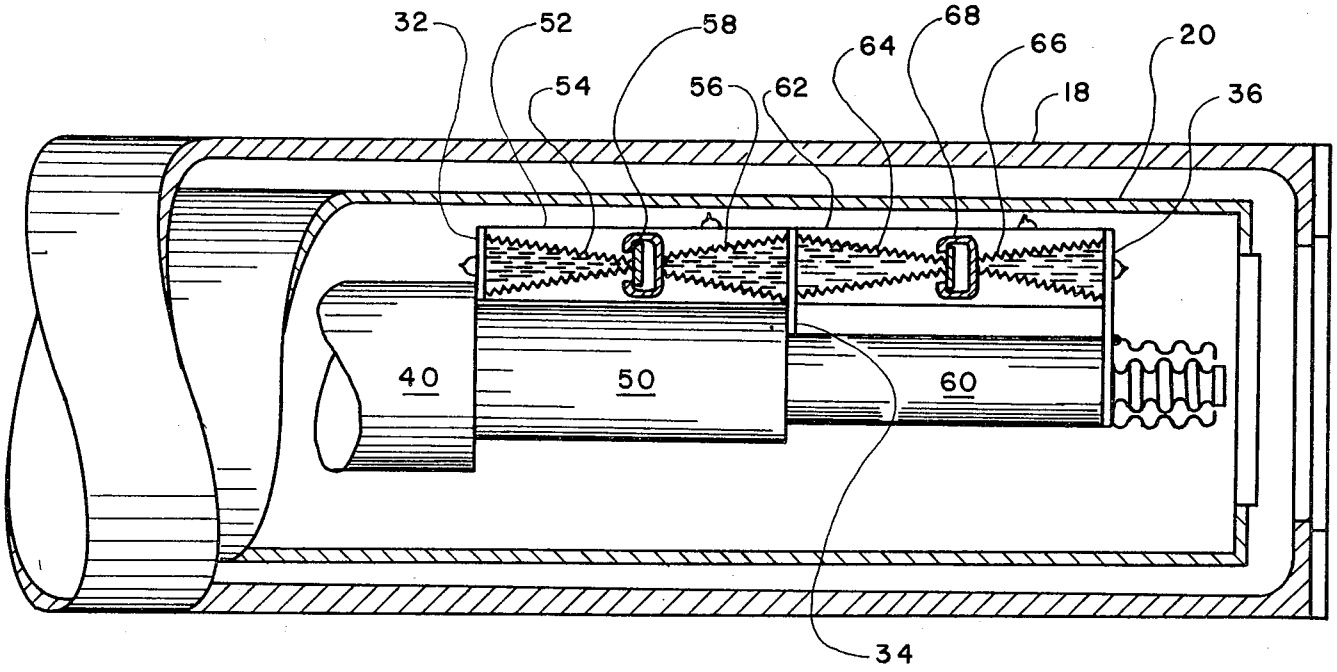
FIG. 4 illustrates a partial view of some of the plurality of cooler stage bellows type thermal switches.
Figure 5:
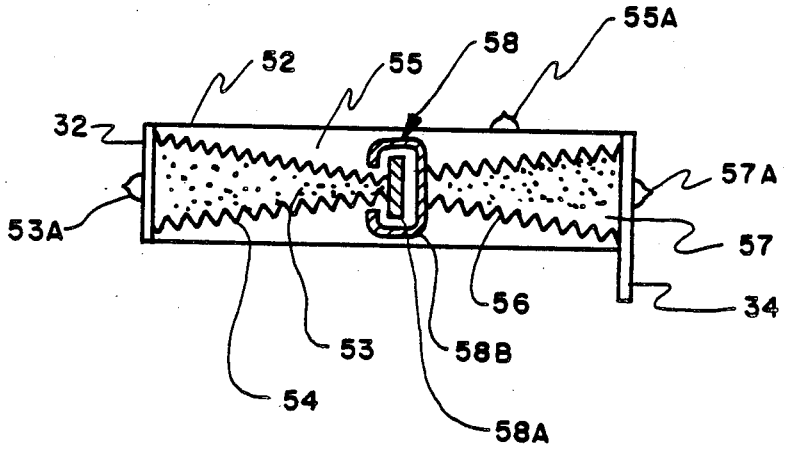
FIG. 5 illustrates a typical cooler stage thermal switch prior to cool down.
Figure 6:
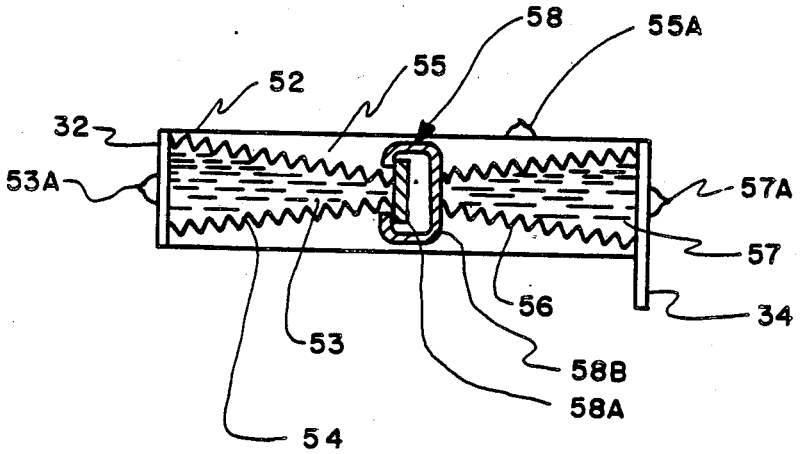
FIG. 6 illustrates a typical cooler stage thermal switch after cool down.

Refer now to FIGS. 4,5, and 6 for an explanation of the multistage cooler which uses the plurality of cooler stage bellows type thermal switches with only the switches for the second stage 50 and third stage 60 shown. The switch for the first stage 40 would however be the same as for the second and third stages. It should be noted also that like numerals represent the cold station thermal switch in FIG. 4 as was discussed herein above. The cooler stage bellows type thermal switches are shown as only one per stage. However, it would probably be preferred that about three or four be used per stage and symmetrically positioned around each stage. Each switch is enclosed in a stainless steel outer pipe represented by 52 and 62 respectively for second and third stages. First and second bellows 54 and 56 for the second stage 50 and 64 and 66 respectively for the third stage 60 are connected on opposite sides of the second stage thermal switch 58 and third stage thermal switch 68 respectively. These thermal switch are connected between connecting conductive plates that are attached at the cold sides of the various stages. Numeral 32 represents the first stage conductive plate, while numerals 34 and 36 represent respectively the second and third stage conductive plates.

Refer now to FIGS. 5 and 6 for conditions of one of the second stage thermal switches 58 respectively before the cooler operation is started when the two sides of the thermal switches 58A and 58B are normally separated and after the cooler is cooled down when the sides 58A and 58B are closed and there is thermal conduction between the conducting plates 32 and 34. Thermal switch 58 operates in the following manner. The two bellows 54 and 56 have cauities 53 and 57 respectively which are filled with a cooling gas and are pinched off at pinch offs 53A and 57A. Cavity 55 is evaluated and pinched off at 55A. As the cooler starts operating and the temperatures begin to cool down the cooling gas in the bellows 54 and 56 begin to liquify. The bellows will then start to contract so that the sides of the switches will contact each other as shown in FIG. 6. Since the liquified gas is a good conductor and the switch is closed, thermal conduction is maximum at this time. The thermal switches may be filled with either helium, hydrogen, nitrogen, oxygen, or argon. Preferably the first and second stages thermal switches are filled with nitrogen which crystallizes at 60° K. while the third stage thermal switch is filled with hydrogen which crystallizes at 10° K. The temperatures at the cold ends of the stages are respectively 77° K. at the first stage, 20° K. at the second stage, and 7° K. at the third stage under these circumstances.

It should be noted that the cooler stage bellows type thermal switches may be immediately closed on start of the cooler system by some other means, such as by being closed electronically, rather than by the liquifying cooling gas process explained above.

I claim:

1. A method of speeding the cool down and prolonging the cold temperature times of a cryogenic cooler comprised the steps of:

providing a plurality of cooler stage bellows type thermal switches on the stages of the cold finger of said cryogenic cooler wherein said cooler stage bellows type thermal switches close during cool down to provide a huge heat sink;

attaching a cold station thermal switch on the end of said cold finger in cooperation with a detector on the end of an inner dewar wall of said cooler; and precooling said cold finger to cryogenic temperature to cause contraction thereof prior to inserting into said inner dewar to prevent damage to any of the cooler elements and filling said inner dewar wall with cooling liquid and direct thermal conductivity between said cold finger and said detector prior to cool down and is opened at the cool down cryogenic temperature to eliminate mechanical vibrations transferred from the cooler system through said cold finger to said detector.

2. The method of claim 1 wherein the step of providing a plurality of cooler stage bellows type thermal switches is comprised of symmetrically positioning at least three bellows type thermal switches around each stage of said cold finger.

3. The method of claim 2 wherein the step of attaching a cold station thermal switch is comprised of attaching an inner bellows to the end of said cold finger and providing a metalic bumper on the end thereof contiguous with said detector and attaching on outer bellows around the outer portion of the end of said cold finger and extending toward the end of said inner dewar wall but never in contact therewith, said inner and outer bellows separated by at least three evenly spaced glass spokes to provide a cooling liquid space therebetween in which said outer bellows is a very poor thermal conductor at cryogenic temperatures to isolate the conductive inner bellows.

4. The method of claim 3 wherein the step of attaching an inner bellows is by welding to the end of said cold finger and the step of attaching an outer bellows is by snap attaching said outer bellows in an annular groove around the end portion of said cold finger.

5. The method of claim 4 wherein the step of precooling said cold finger is by start up of the cooler system until said cold finger reaches cryogenic temperature.

6. The method of claim 5 wherein the step of providing a plurality of cooler stage bellows type thermal switches is comprised of providing for a three stage cooler wherein each thermal switch has a stainless steel outer pipe and first and second copper bellows connected between opposite sides of a normally open switch and to conductive plates attached on the cold sides of the various stages wherein each of said bellows are filled with a cooling gas and are pinched off and the remaining space within said stainless steel outer pipe are evacuated and pinched off wherein as said cryogenic cooler is cooled down said cooling gas liquifies and said copper bellows contract to close said normally open switch.

7. The method of claim 6 wherein the step of providing for a three stage cooler is comprised of a closed cycle cooler.

8. The method of claim 7 wherein the step of filling first and second copper bellows of said cooler stage bellows type thermal switches with a cooling gas is comprised of filling with one or a combination of the gases comprised of helium, hydrogen, oxygen, nitrogen, and argon so that all switches are closed simultaneously.

9. The method of claim 8 wherein said plurality of cooler stage bellows type thermal switches are simultaneously switched electronically.

10. The method of claim 7 wherein the step of filling first and second bellows of said cooler stage bellows type thermal switches with a cooling gas is comprised of filling the thermal switches of the first and second stages with nitrogen gas which crystalizes at 60° K. and of filling the thermal switches of the third stage with hydrogen gas which crystalizes at 10° K. so that said switches are closed in cascade.

11. The method as set forth in claim 6 wherein the step of providing for a three stage cooler is comprised of a Joule-Thompson cryostat.

12. A high speed cool down and prolonged cold temperature cryogenic cooler comprising:

a plurality of cooler stage bellows type thermal switches symmetrically positioned around each stage of a multistage cooler cold finger; and a cold station bellows thermal switch on the end of said cold finger in thermal cooperation with a detector on the end of an inner dewar wall of said cooler in which said cold finger is mounted in a cooling gas filled cavity enclosed by said inner dewar wall and flanges connecting said cold finger to a cooler system wherein said plurality of cooler stage bellows type thermal switches close during cool down to provide a hugh heat sink to cool said detector and said cold station bellows thermal switch physically separates from said detector at the cool down cryogenic temperatures to prevent mechanical vibrations from said cooler system being transferred to said detector while said hugh heat sink maintains vibration free cryogenic temperatures on said detector.

* * * * *